US007786973B2

(12) United States Patent
Shih

(10) Patent No.: US 7,786,973 B2
(45) Date of Patent: Aug. 31, 2010

(54) DISPLAY DEVICE AND METHOD

(75) Inventor: Ming-Chia Shih, Tainan County (TW)

(73) Assignee: Chi Mei Optoelectronics Corp. (TW)

( * ) Notice: Subject to any disclaimer, the term of this patent is extended or adjusted under 35 U.S.C. 154(b) by 923 days.

(21) Appl. No.: 11/391,681

(22) Filed: Mar. 29, 2006

(65) Prior Publication Data

US 2006/0238487 A1 Oct. 26, 2006

(30) Foreign Application Priority Data

Mar. 29, 2005 (TW) ..... 94109898 A

(51) Int. Cl.
*G09G 3/36* (2006.01)

(52) U.S. Cl. ..... 345/102; 345/89

(58) Field of Classification Search ..... 345/102, 345/89

See application file for complete search history.

(56) References Cited

U.S. PATENT DOCUMENTS 6,095,656 A * 8/2000 Shimura et al. ..... 362/97
6,795,053 B1 * 9/2004 Funamoto et al. ..... 345/102
6,987,499 B2 1/2006 Yamaguchi et al.
7,084,562 B2 8/2006 Kurachi et al.
7,109,984 B2 * 9/2006 Moon ..... 345/212
7,333,081 B2 * 2/2008 Aoki et al. ..... 345/102
7,365,723 B2 * 4/2008 Lee et al. ..... 345/89
7,394,448 B2 * 7/2008 Park et al. ..... 345/102
7,465,104 B2 * 12/2008 Tokui et al. ..... 385/65
2006/0181503 A1 * 8/2006 Feng ..... 345/102

FOREIGN PATENT DOCUMENTS

JP 2004070193 A 3/2004

* cited by examiner

*Primary Examiner*—Alexander Eisen
*Assistant Examiner*—Viet Pham

(57) ABSTRACT

A region-based image display device includes a backlight module, a separating unit, a signal-processing unit, and a modulation unit. The backlight module includes several backlight regions. Each backlight region includes an adjustable luminance unit. Each luminance unit has a basis luminance value. The separating unit separates an input image signal into several image region signals corresponding to the backlight regions. The signal-processing unit transforms the image region signals into several output image signals. The modulation unit adjusts the basis luminance values to output luminance values according to the image region signals. Each basis luminance value and the corresponding image region signal on the one hand, and the corresponding output luminance value and output image signal, on the other hand, cooperatively define substantially the same chromaticity and brightness.

5 Claims, 4 Drawing Sheets

DISPLAY DEVICE AND METHOD

This application claims the benefit of Taiwan application Serial No. 94109898, filed Mar. 29, 2005, the entirety of which is incorporated herein by reference.

BACKGROUND OF THE INVENTION

1. Field of the Invention

The invention relates in general to a display device and a displaying method, and more particularly, to a region-based image display device and a region-based image displaying method.

2. Description of the Related Art

The backlight module of a conventional display device has a constant luminance. Therefore, when displaying images with different brightness, the luminance of the backlight module cannot be changed. Images with lower brightness are displayed using the same luminance used for displaying image with higher brightness. As a result, electrical power is wasted. Philips Electronics uses the Adaptive Dynamic Image Control cooperating with an in-plane switching mode display device. The whole luminance of the backlight module is dynamically adjusted according to the gray scale of the image. In other words, when the brightness of the image is high, the luminance value of the whole backlight module is adjusted to a higher value. When the brightness of the image is low, the luminance value of the whole backlight module is adjusted to a lower value. However, in general, the gray scale values of one image vary widely from one region of the image to another. Therefore, with the Adaptive Dynamic Image Control, different parts of one image with different gray scale values cannot be displayed by different luminance values at the same time. The luminance of the conventional backlight module cannot be adjusted effectively.

SUMMARY OF THE INVENTION

It is therefore an object of the invention to provide a region-based image display device and an image displaying method. A backlight module and an input image signal are separated regionally, so that luminance of the backlight module is used effectively, thereby saving electricity.

The invention achieves the above-identified and other objects by providing a region-based image display device, for displaying an image regionally. The region-based image display device includes a backlight module, a separating unit, a signal-processing unit, and a modulation unit. The backlight module has several backlight regions. Each backlight region includes an adjustable luminance unit. Each luminance unit has a basis luminance value. The separating unit is configured for separating an input image signal into several image region signals. Each image region signal corresponds to one of the backlight regions. The signal-processing unit is configured for receiving the image region signals and transforming the image region signals into several output image signals. The modulation unit adjusts the basis luminance values to the output luminance values according to the image region signals. Each basis luminance value and the corresponding image region signal, on one hand, and the corresponding output luminance value and output image signal, on the other hand, cooperatively define substantially the same chromaticity and brightness.

The invention achieves the above-identified and other objects by providing an image displaying method for use in a region-based image display device, and for displaying an image regionally. In accordance with the method, a backlight module is disposed in the display device. The backlight module has several backlight regions. Each backlight region includes an adjustable luminance unit. Each luminance unit has a basis luminance value. An input image signal is separated into several image region signals. Each image region signal corresponds to one of the backlight regions. According to the image region signals, each basis luminance value is adjusted to a corresponding output luminance value. Each output luminance value and the corresponding output image signal on one hand, and the corresponding basis luminance value and image region signal on the other hand, cooperatively define substantially the same chromaticity and brightness.

Other objects, features, and advantages of the invention will become apparent from the following detailed description of the preferred but non-limiting embodiments. The following description is made with reference to the accompanying drawings.

DETAILED DESCRIPTION OF THE INVENTION

A backlight module is separated regionally in the invention, so that the luminance value of the backlight module is regionally adjustable. Also, the input image signals are transformed accordingly. As a result, the regionally adjustable backlight module and the transformed image signals cooperatively display substantially the same chromaticity and brightness of an original image. The object of the regional separation is to separate the foreground and background of the image. In other words, the regions with different brightness are separated. The area of each region does not need to be the equal or symmetric. When the number of the regions increases, the efficiency of regionally controlling the luminance of the backlight module becomes better. And power consumption is lower. However, the cost increases correspondingly.

Figure 1A:
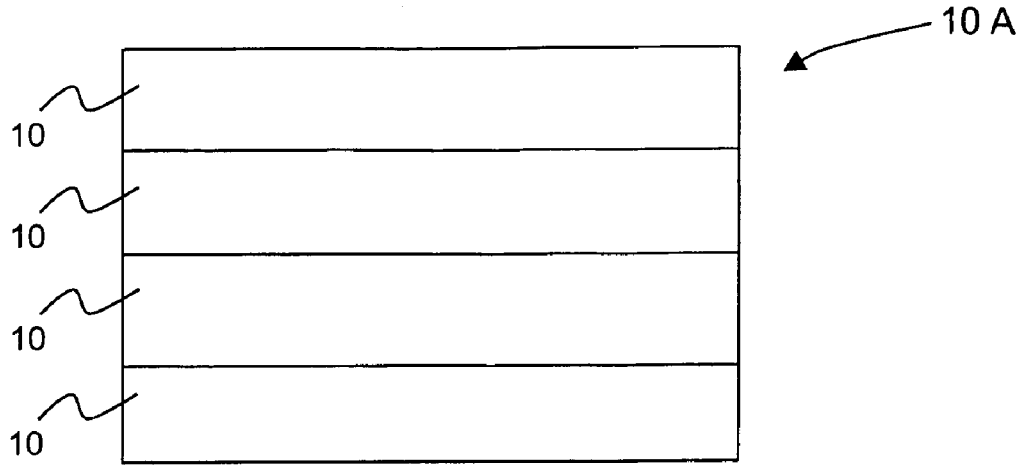
FIG. 1A, FIG. 1B, FIG. 1C and FIG. 1D are schematic views showing backlight region arrangements in a region-based display device in accordance with various embodiments of the invention.
Figure 1B:
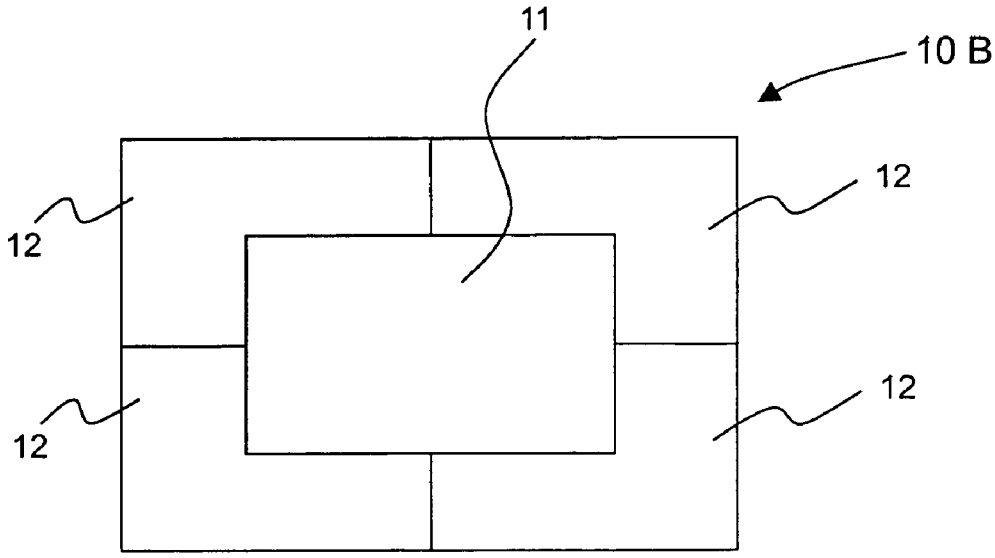
Figure 1C:
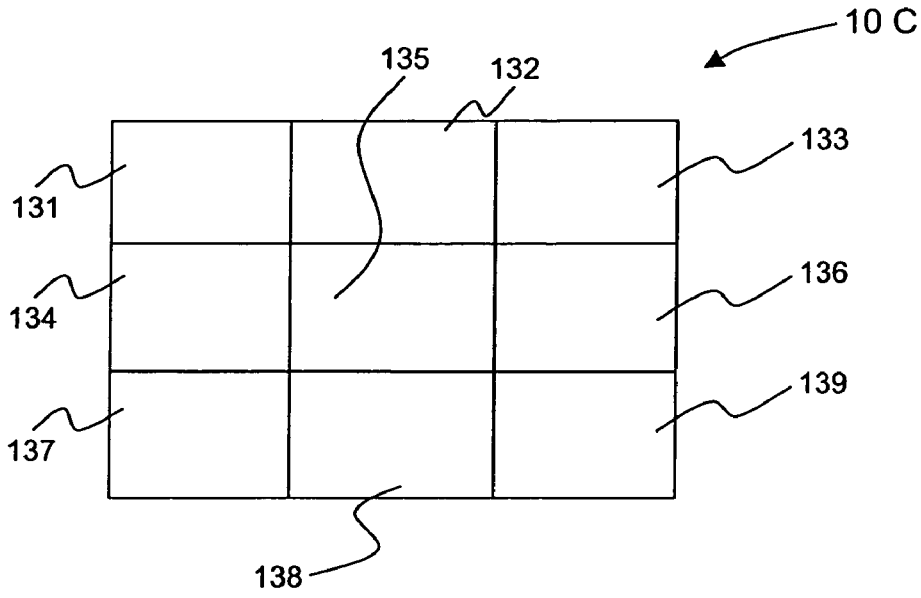
Figure 1D:
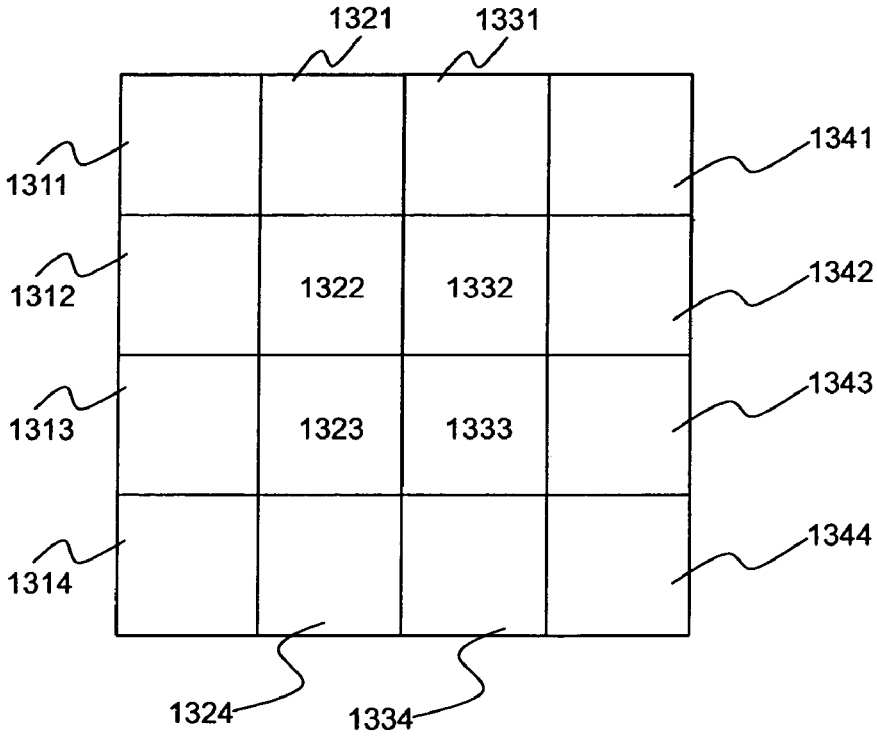

FIG. 1A, FIG. 1B, FIG. 1C and FIG. 1D are schematic views showing backlight region arrangements in a region-based display device in accordance with various embodiments of the invention. In FIG. 1A, a backlight module 10A is separated into four equal backlight regions 10. In FIG. 1B, a backlight module 10B is separated into a central backlight region 11 and four peripheral backlight regions 12. In FIG. 1C, a backlight module 10C is separated into nine equal backlight regions 131 to 139. In FIG. 1D, a backlight module 10D is separated into sixteen equal backlight regions 1311, 1321 to 1344. Other arrangements are not excluded from the scope of the present invention.

Figure 2:
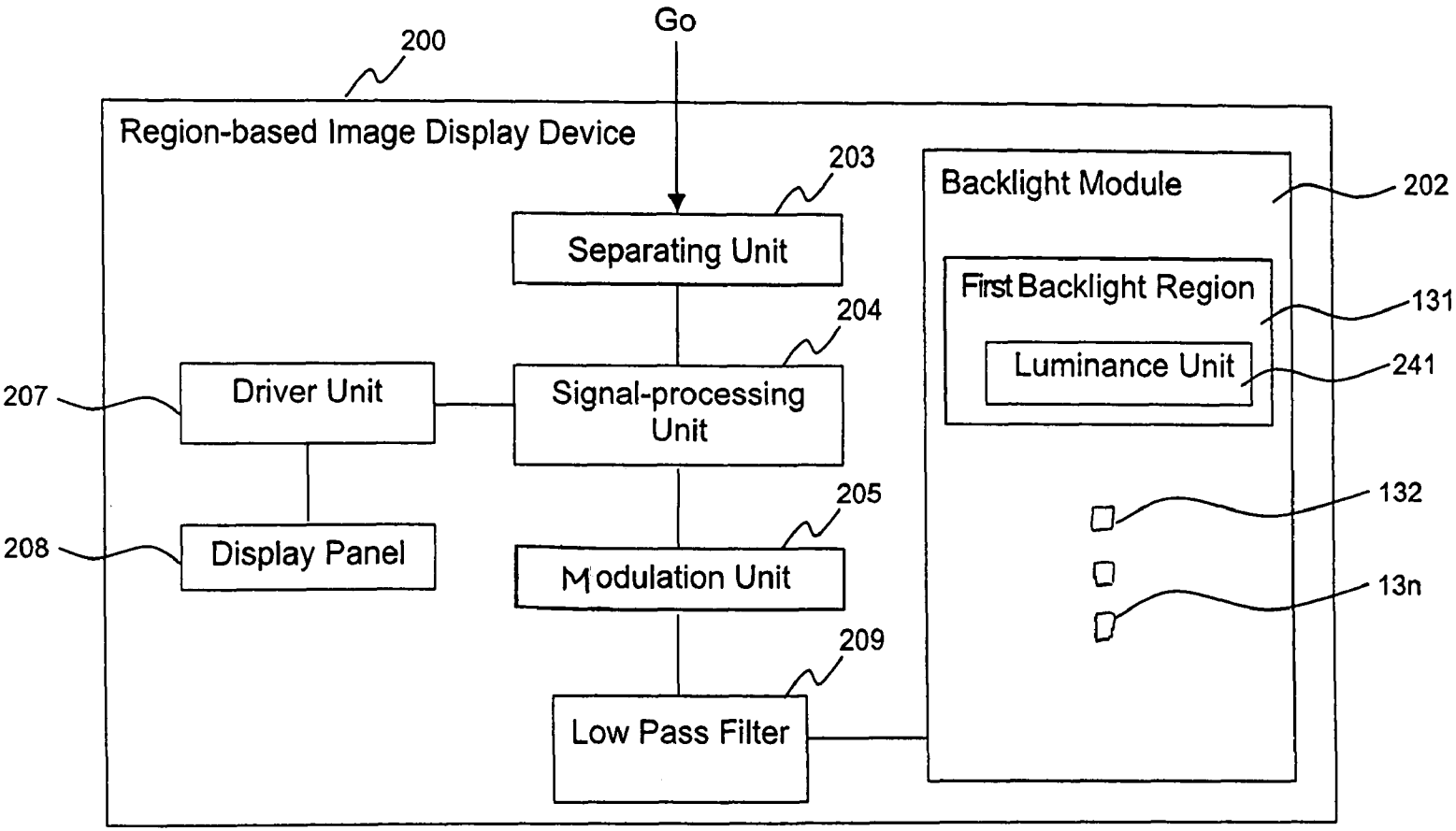
FIG. 2 is a block diagram of a region-based image display device according to a preferred embodiment of the invention.

FIG. 2 is a block diagram of a region-based image display device 200 according to a preferable embodiment of the invention. In FIG. 2, the region-based image display device 200 is configured for displaying an image regionally. The region-based image display device 200 at least includes a backlight module 202, a separating unit 203, a signal-processing unit 204 and a modulation unit 205. The region-based image display device 200 can preferably further includes a driver unit 207, a display panel 208 and a low pass filter 209.

For example, the image display device 200 can have a gamma curve value (γ) and a gamma curve, for showing the relation between luminance value (B) and a gray scale value (G) of the display 200. The relation can be in the form of a function, such as, $B=Gamma_{\gamma}(G)$. The gamma curve value (γ) is preferably 2.2. Alternatively, the relation between the luminance value (B) and the gray scale value (G) can be in the form of a look-up table. In other words, the relation between the luminance value (B) and the gray scale value (G) can be B=LUT(G).

The backlight module 202 can be a cold cathode fluorescent lamp (CCFL) backlight module, a light emitting diode (LED) backlight module, or any other kind of backlight module. A white light cold cathode fluorescent lamp backlight module is illustrated in the present embodiment of the invention as an example. However, the invention is not limited thereto. It is within the scope of the invention to use any backlight module.

The backlight module 202 includes several backlight regions, for example, from the first backlight region 131, the second backlight region 132 to the $n^{th}$ backlight 13*n*, where n is an integer. Each backlight region includes a luminance unit. For example, the first backlight region 131 includes a luminance unit 241. Each luminance unit has a basis luminance value, such as $B_1$ for luminance unit 241 of first backlight region 131, $B_2$ for the luminance unit of second backlight region 132, etc. Each luminance unit includes one or more light emitting elements, such as, cold cathode fluorescent lamps (CCFLs), light emitting diodes (LEDs) etc.

The separating unit 203 is configured for separating an input image signal $G_0$ into several image region signals $G_1$, $G_2$, . . . $G_n$ for the first through $n^{th}$ backlight regions, respectively. The signal-processing unit 204 is connected to the separating unit 203, for receiving the image region signals $G_1$, $G_2$, . . . $G_n$ and transforming the image region signals $G_1$, $G_2$, . . . $G_n$ to several output image signals $G_{21}$, $G_{22}$, . . . $G_{2n}$, respectively. The modulation unit 205 is connected to the signal-processing unit 204, for adjusting the basis luminance values $B_1$, $B_2$, . . . $B_n$ to output luminance values $B_{21}$, $B_{22}$, . . . $B_{2n}$, respectively, according to the image region signals $G_1$, $G_2$, . . . $G_n$, respectively. The driver unit 207 is connected to the signal-processing unit 204, for receiving the output image signals $G_{21}$, $G_{22}$, . . . $G_{2n}$, respectively transmitted by the signal-processing unit 204. The driver unit 207 drives the display panel 208 accordingly.

The low pass filter 209 is connected to the modulation unit 205, for receiving output luminance values $B_{21}$, $B_{22}$, . . . $B_{2n}$, respectively, and outputting adjusted luminance values $B_{31}$, $B_{32}$, . . . $B_{3n}$, respectively, so that the luminance units of the first through $n^{th}$ backlight regions are controlled to have the adjusted luminance values $B_{31}$, $B_{32}$, . . . $B_{3n}$, respectively. The low pass filter 209 is configured to properly reflect the actual luminance of each backlight region under the influence of the others. As a result, the luminance difference among the backlight regions decreases, and the discontinuity of the image is improved. It is within the scope of the present invention to eliminate low pass filter 209, in which case the region-based display in accordance with a further embodiment of the invention can modulate the luminance units directly by the modulation unit 205.

Figure 3:
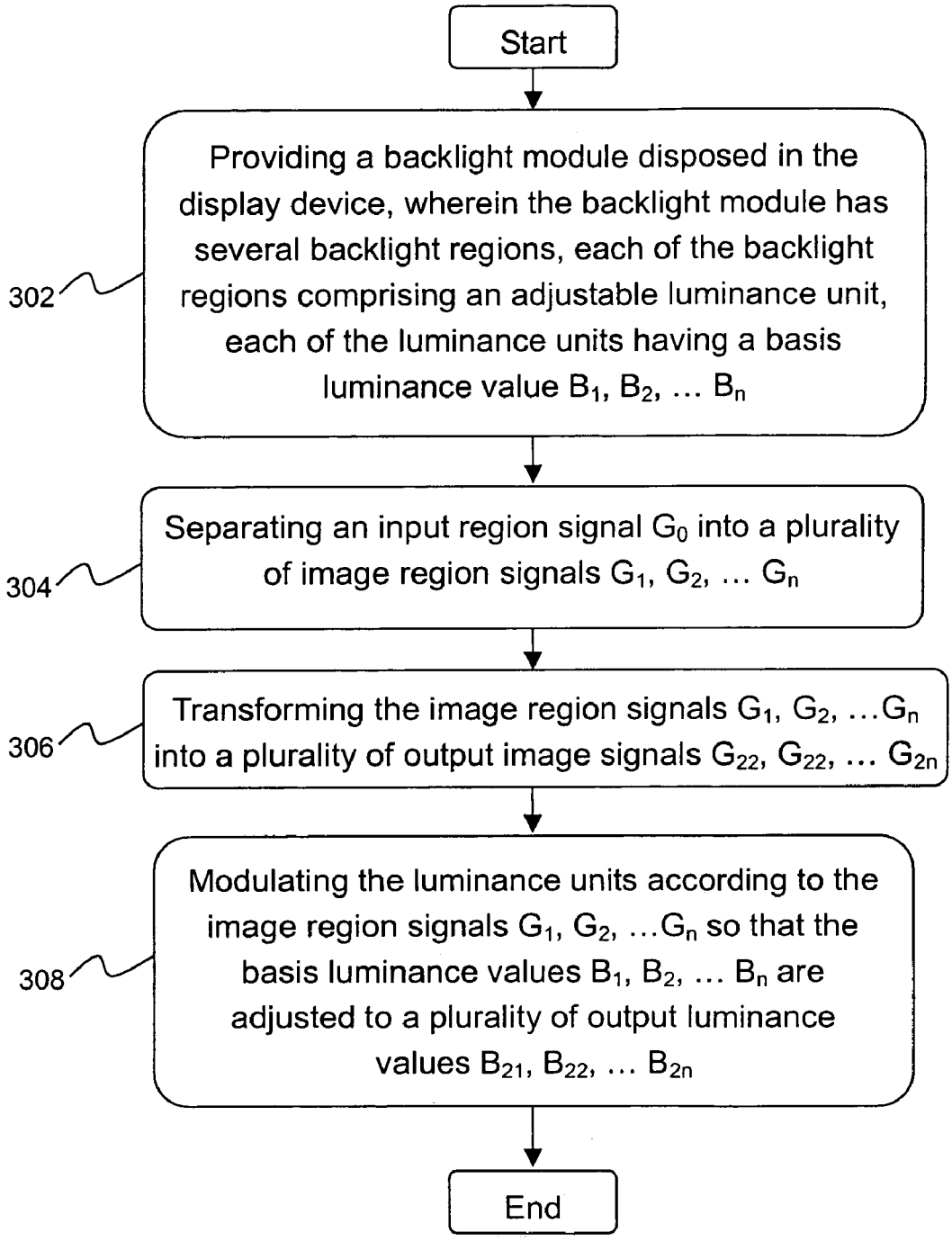
FIG. 3 is a flow chart of a displaying method for use in a region-based image display device according to a preferred embodiment of the invention.

FIG. 3 is a flow chart of an image displaying method for use in the region-based image display device 200 of FIG. 2.

First, as shown in step 302, a backlight module 202 is provided. The backlight module 202 including several backlight regions 131, 132, . . . 13*n* is disposed in the display device 200. Each backlight region includes an adjustable luminance unit, such as luminance unit 241 for the first backlight region 131. Each luminance unit has a basis luminance value, such as, $B_1$, $B_2$, . . . $B_n$.

Next, as shown in step 304, the separating unit 203 separates the input image signal $G_0$ into several image region signals $G_1$, $G_2$, . . . $G_n$. Each image region signal $G_1$, $G_2$ . . . $G_n$ is intended for one of the backlight regions 131, 132, . . . 13*n*, respectively, of the backlight module 202. Each of the basis luminance values $B_1$, $B_2$, . . . $B_n$ and the corresponding image region signal $G_1$, $G_2$, . . . $G_n$ cooperatively provide chromaticity and brightness for the image portion to be displayed in the respective backlight region 131, 132, . . . 13*n*.

Then, as shown in step 306, the signal-processing unit 204 transforms the image region signals $G_1$, $G_2$, . . . $G_n$ into several output image signals $G_{21}$, $G_{22}$, . . . $G_{2n}$, respectively. For example, the maximum gray scale value ($M_1$, $M_2$, . . . $M_n$) of each image region signal $G_1$, $G_2$, . . . $G_n$ is first determined. The maximum gray scale value (M) can be, for example, between 0 and 255. Then, according to the determined maximum gray scale value ($M_1$, $M_2$, . . . $M_n$), each image region signal $G_1$, $G_2$, . . . $G_n$ is transformed into the corresponding output image signal $G_{21}$, $G_{22}$, . . . $G_{2n}$, for example, through linear magnification. For example, the output image signal $G_{2i}$ is represented by $$G_{2i} = G_i \times \frac{255}{M_i},$$

where i=1~n.

Afterward, as shown in step 308, the modulation unit 205 controls the luminance units according to the corresponding image region signals $G_1$, $G_2$, . . . $G_n$. As a result, the basis luminance values $B_1$, $B_2$, . . . $B_n$ of the luminance units are adjusted to have the output luminance values $B_{21}$, $B_{22}$, . . . $B_{2n}$, respectively. Each output luminance value $B_{21}$, $B_{22}$, . . . $B_{2n}$ and the corresponding output image signal $G_{21}$, $G_{22}$, . . . $G_{2n}$ cooperatively provide substantially the same chromaticity and brightness as the corresponding basis luminance value $B_1$, $B_2$, . . . $B_n$ and the corresponding image region signal $G_1$, $G_2$, . . . $G_n$. For example, each basis luminance value $B_1$, $B_2$, . . . $B_n$ is adjusted to the corresponding output luminance value $B_{21}$, $B_{22}$, . . . $B_{2n}$ according to the maximum gray scale value ($M_1$, $M_2$, . . . $M_n$) of the corresponding image region signal $G_1$, $G_2$, . . . $G_n$. The output luminance values $B_{21}$, $B_{22}$, . . . $B_{2n}$ can be expressed as $B_{2i}=100\%\times Gamma_{\gamma}(M_i)$, where i=1~n.

The adjusting step 308 can further include the following sub-steps (not shown). A low pass filter 209 is installed in the display device 200. Next, the low pass filter 209 receives the output luminance values $B_{21}$, $B_{22}$, . . . $B_{2n}$ and obtains adjusted luminance values $B_{31}$, $B_{32}$, . . . $B_{3n}$, respectively, through, e.g., linear superposition of the output luminance values $B_{21}$, $B_{22}$, . . . $B_{2n}$. Then, the luminance units are controlled to have the adjusted luminance values $B_{31}$, $B_{32}$, . . . $B_{3n}$, respectively.

The backlight region arrangement of FIG. 1C will now be used to exemplarily describe the operation of the low pass filter 209 in detail. In other words, the backlight module 202 is separated into nine equal backlight regions 131 to 139 (i.e., n=9).

The low pass filter 209 receives the output luminance values $B_{21}$, $B_{22}$, . . . $B_{29}$, from the modulation unit 205, intended for the first backlight region 131 to the ninth backlight region 139. Take the fifth backlight region 135 (i.e., i=5) as an example. The low-pass filter 209 obtains the adjusted luminance value $B_{35}$ intended for the fifth backlight region 135 through convolution of all the output luminance values $B_{21}$, $B_{22}$, . . . $B_{29}$. The adjusted luminance value $B_{35}$ of the fifth backlight region 135 is preferably expressed as:

$$B_{35} = \begin{bmatrix} B_{21} & B_{22} & B_{23} \\ B_{24} & B_{25} & B_{26} \\ B_{27} & B_{28} & B_{29} \end{bmatrix} * \begin{bmatrix} F_1 & F_2 & F_3 \\ F_4 & F_5 & F_6 \\ F_7 & F_8 & F_9 \end{bmatrix}$$
$$= B_{21} \times F_1 + B_{22} \times F_2 + B_{23} \times F_3 + B_{24} \times F_4 + B_{25} \times F_5 + B_{26} \times F_6 + B_{27} \times F_7 + B_{28} \times F_8 + B_{29} \times F_9$$

Each parameter, i.e., $F_1$, $F_2$, . . . $F_9$, of the low pass filter 209 can be modified according to the influence among the backlight regions 131-139. For example, as shown in FIG. 1C, the second backlight region 132, the fourth backlight region 134, the sixth backlight region 136 and the eighth backlight region 138 are adjacent to the fifth backlight region 135. Therefore, the influence between these backlight regions 132, 134, 136, 138 and the fifth backlight region 135 is more significant. The parameters $F_1$, $F_2$, . . . $F_9$ of the low-pass filter 209 are preferably set, for fifth backlight region 135, as follows:

$$\begin{bmatrix} F_1 & F_2 & F_3 \\ F_4 & F_5 & F_6 \\ F_7 & F_8 & F_9 \end{bmatrix} = \begin{bmatrix} 0 & 0.125 & 0 \\ 0.125 & 0.5 & 0.125 \\ 0 & 0.125 & 0 \end{bmatrix}$$

In other words, $B_{35}=0.125\times B_{22}+0.125\times B_{24}+0.5\times B_{25}+0.125\times B_{26}+0.125\times B_{28}$.

However, parameters $F_1$, $F_2$, . . . $F_9$, of the low pass filter 209 are not limited to the above disclosed values, and can be adjusted depending on concrete applications. For example, if it is desirable to give higher weight to the central region 135, the parameters can be adjusted as follows: $F_1=0$, $F_2=0.05$, $F_3=0$, $F_4=0.05$, $F_5=0.8$, $F_6=0.05$, $F_7=0$, $F_8=0.05$, and $F_9=0$ for example. If it is desirable to give higher weight to the surrounding backlight regions, the parameters can be adjusted as follows: $F_1=0$, $F_2=0.15$, $F_3=0$, $F_4=0.15$, $F_5=0.4$, $F_6=0.15$, $F_7=0$, $F_8=0.15$, and $F_9=0$, for example. It is also within the scope of the present invention to set the parameters $F_1$-$F_9$ at the same value, i.e., to give all backlight region the same weight.

It should be noted that the set of parameters $F_1$, $F_2$, . . . $F_9$, of the low pass filter 209 may vary from one backlight region to another. In particular, the peripheral backlight regions 131-134 and 136-139 each do not have all eight other surrounding backlight regions as the central backlight region 135, and preferably have different sets of parameters $F_1$, $F_2$, . . . $F_9$ depending on their positions. For example:

$$\text{for backlight region 131, } \begin{bmatrix} F_1 & F_2 & F_3 \\ F_4 & F_5 & F_6 \\ F_7 & F_8 & F_9 \end{bmatrix} = \begin{bmatrix} 0 & 0 & 0 \\ 0 & 0.5 & \frac{0.5}{3} \\ 0 & \frac{0.5}{3} & \frac{0.5}{3} \end{bmatrix},$$

-continued $$\text{for backlight region 132, } \begin{bmatrix} F_1 & F_2 & F_3 \\ F_4 & F_5 & F_6 \\ F_7 & F_8 & F_9 \end{bmatrix} = \begin{bmatrix} 0 & 0 & 0 \\ 0.1 & 0.5 & 0.1 \\ 0.1 & 0.1 & 0.1 \end{bmatrix},$$

$$\text{for backlight region 133, } \begin{bmatrix} F_1 & F_2 & F_3 \\ F_4 & F_5 & F_6 \\ F_7 & F_8 & F_9 \end{bmatrix} = \begin{bmatrix} 0 & 0 & 0 \\ \frac{0.5}{3} & 0.5 & 0 \\ \frac{0.5}{3} & \frac{0.5}{3} & 0 \end{bmatrix},$$

$$\text{for backlight region 134, } \begin{bmatrix} F_1 & F_2 & F_3 \\ F_4 & F_5 & F_6 \\ F_7 & F_8 & F_9 \end{bmatrix} = \begin{bmatrix} 0 & 0.1 & 0.1 \\ 0 & 0.5 & 0.1 \\ 0 & 0.1 & 0.1 \end{bmatrix},$$

$$\text{for backlight region 136, } \begin{bmatrix} F_1 & F_2 & F_3 \\ F_4 & F_5 & F_6 \\ F_7 & F_8 & F_9 \end{bmatrix} = \begin{bmatrix} 0.1 & 0.1 & 0 \\ 0.1 & 0.5 & 0 \\ 0.1 & 0.1 & 0 \end{bmatrix},$$

$$\text{for backlight region 137, } \begin{bmatrix} F_1 & F_2 & F_3 \\ F_4 & F_5 & F_6 \\ F_7 & F_8 & F_9 \end{bmatrix} = \begin{bmatrix} 0 & \frac{0.5}{3} & \frac{0.5}{3} \\ 0 & 0.5 & \frac{0.5}{3} \\ 0 & 0 & 0 \end{bmatrix},$$

$$\text{for backlight region 138, } \begin{bmatrix} F_1 & F_2 & F_3 \\ F_4 & F_5 & F_6 \\ F_7 & F_8 & F_9 \end{bmatrix} = \begin{bmatrix} 0.1 & 0.1 & 0.1 \\ 0.1 & 0.5 & 0.1 \\ 0 & 0 & 0 \end{bmatrix},$$

and $$\text{for backlight region 139, } \begin{bmatrix} F_1 & F_2 & F_3 \\ F_4 & F_5 & F_6 \\ F_7 & F_8 & F_9 \end{bmatrix} = \begin{bmatrix} \frac{0.5}{3} & \frac{0.5}{3} & 0 \\ \frac{0.5}{3} & 0.5 & 0 \\ 0 & 0 & 0 \end{bmatrix}.$$

The sets of parameters $F_1$, $F_2$, . . . $F_9$ for the peripheral backlight regions 131-134, and 136-139 can also be adjusted depending on concrete applications, as discussed above with respect to the set of parameters $F_1$, $F_2$, . . . $F_9$ for the central backlight region 135.

The sets of parameters $F_1$, $F_2$, . . . $F_9$ for the peripheral backlight regions and central region disclosed above can also be applied to other arrangements of backlight region, such as the one shown in FIG. 1D. In the embodiment of FIG. 1D, there are four central backlight regions 1322, 1332, 1323, 1333 and the remaining backlight regions are peripheral backlight regions. The low pass filter 209 preferably uses the set of parameters $F_1$, $F_2$, . . . $F_9$ of the central backlight region 135 for central backlight regions 1322, 1332, 1323, 1333. Backlight region 1311 is equivalent to backlight region 131 and the low pass filter 209 preferably uses the set of parameters $F_1$, $F_2$, . . . $F_9$ of backlight region 131 for backlight region 1311. Similarly, the low pass filter 209 preferably uses the set of parameters $F_1$, $F_2$, . . . $F_9$ of backlight region 132 for backlight regions 1321, 1331, the set of parameters $F_1$, $F_2$, . . . $F_9$ of backlight region 133 for backlight region 1341, etc.

An example for calculating the adjusted luminance values is presented below:

The output luminance values for the backlight regions of FIG. 1D are:

$$\begin{bmatrix} B_{2(1,1)} & B_{2(2,1)} & B_{2(3,1)} & B_{2(4,1)} \\ B_{2(1,2)} & B_{2(2,2)} & B_{2(3,2)} & B_{2(4,2)} \\ B_{2(1,3)} & B_{2(2,3)} & B_{2(3,3)} & B_{2(4,3)} \\ B_{2(1,4)} & B_{2(2,4)} & B_{2(3,4)} & B_{2(4,4)} \end{bmatrix} = \begin{bmatrix} 5 & 25 & 60 & 65 \\ 50 & 10 & 40 & 35 \\ 55 & 30 & 15 & 80 \\ 45 & 70 & 75 & 20 \end{bmatrix}$$

The adjusted luminance value $B_{3(2,2)}$ of backlight region 1322 is calculated using the following parameters $$\begin{bmatrix} F_1 & F_2 & F_3 \\ F_4 & F_5 & F_6 \\ F_7 & F_8 & F_9 \end{bmatrix} = \begin{bmatrix} 0 & 0.125 & 0 \\ 0.125 & 0.5 & 0.125 \\ 0 & 0.125 & 0 \end{bmatrix}$$

$$\begin{aligned} B_{3(2,2)} &= \begin{bmatrix} B_{2(1,1)} & B_{2(2,1)} & B_{2(3,1)} \\ B_{2(1,2)} & B_{2(2,2)} & B_{2(3,2)} \\ B_{2(1,3)} & B_{2(2,3)} & B_{2(3,3)} \end{bmatrix} * \begin{bmatrix} F_1 & F_2 & F_3 \\ F_4 & F_5 & F_6 \\ F_7 & F_8 & F_9 \end{bmatrix} \\ &= B_{2(1,1)} \times F_1 + B_{2(2,1)} \times F_2 + B_{2(3,1)} \times F_3 + B_{2(1,2)} \times F_4 + \\ &\quad B_{2(2,2)} \times F_5 + B_{2(2,3)} \times F_6 + B_{2(1,3)} \times F_7 + B_{2(2,3)} \times F_8 + \\ &\quad B_{2(3,3)} \times F_9 \\ &= 5 \times 0 + 25 \times 0.125 + \\ &\quad 60 \times 0 + 50 \times 0.125 + \\ &\quad 10 \times 0.5 + 40 \times 0.125 + \\ &\quad 55 \times 0 + 30 \times 0.125 + 15 \times 0 \\ &= 23.125. \end{aligned}$$

The adjusted luminance value $B_{3(3,2)}$ of backlight region 1332 is calculated using the same set of parameters $F_1, F_2, \ldots F_9$:

$$\begin{aligned} B_{3(2,2)} &= \begin{bmatrix} B_{2(2,1)} & B_{2(3,1)} & B_{2(4,1)} \\ B_{2(2,2)} & B_{2(3,2)} & B_{2(4,2)} \\ B_{2(2,3)} & B_{2(3,3)} & B_{2(4,3)} \end{bmatrix} * \begin{bmatrix} F_1 & F_2 & F_3 \\ F_4 & F_5 & F_6 \\ F_7 & F_8 & F_9 \end{bmatrix} \\ &= B_{2(2,1)} \times F_1 + B_{2(3,1)} \times F_2 + B_{2(4,1)} \times F_3 + B_{2(2,2)} \times F_4 + \\ &\quad B_{2(3,2)} \times F_5 + B_{2(4,3)} \times F_6 + B_{2(2,3)} \times F_7 + B_{2(3,3)} \times F_8 + \\ &\quad B_{2(4,3)} \times F_9 \\ &= 25 \times 0 + 60 \times 0.125 + 65 \times 0 + 10 \times 0.125 + 40 \times 0.5 + \\ &\quad 35 \times 0.125 + 30 \times 0 + 15 \times 0.125 + 80 \times 0 \\ &= 35. \end{aligned}$$

Thus, although adjusted luminance values, $B_{3(2,2)}$, $B_{3(3,2)}$, $B_{3(2,3)}$ and $B_{3(3,3)}$ of the central backlight regions are calculated using the same parameters $F_1$-$F_9$, the adjusted luminance values usually will not be the same.

The peripheral backlight regions of FIG. 1D do not have eight other surrounding backlight regions, and will have different sets of parameters $F_1$-$F_9$, as discussed above. For example, adjusted luminance values for the peripheral backlight regions are calculated as follows:

$$\begin{aligned} B_{3(1,1)} &= \begin{bmatrix} B_{2(1,1)} & B_{2(2,1)} \\ B_{2(2,1)} & B_{2(2,2)} \end{bmatrix} * \begin{bmatrix} F_1 & F_2 & F_3 \\ F_4 & F_5 & F_6 \\ F_7 & F_8 & F_9 \end{bmatrix} \\ &= \begin{bmatrix} B_{2(1,1)} & B_{2(3,2)} \\ B_{2(2,3)} & B_{2(3,3)} \end{bmatrix} * \begin{bmatrix} 0 & 0 & 0 \\ 0 & 0.5 & \frac{0.5}{3} \\ 0 & \frac{0.5}{3} & \frac{0.5}{3} \end{bmatrix} \end{aligned}$$

$$\begin{aligned} B_{3(2,1)} &= \begin{bmatrix} B_{2(1,1)} & B_{2(2,1)} & B_{2(3,1)} \\ B_{2(1,2)} & B_{2(2,2)} & B_{2(3,2)} \end{bmatrix} * \begin{bmatrix} F_1 & F_2 & F_3 \\ F_4 & F_5 & F_6 \\ F_7 & F_8 & F_9 \end{bmatrix} \\ &= \begin{bmatrix} B_{2(1,1)} & B_{2(2,1)} & B_{2(3,1)} \\ B_{2(1,2)} & B_{2(2,2)} & B_{2(3,2)} \end{bmatrix} * \begin{bmatrix} 0 & 0 & 0 \\ 0.1 & 0.5 & 0.1 \\ 0.1 & 0.1 & 0.1 \end{bmatrix} \end{aligned}$$

$$\begin{aligned} B_{3(4,1)} &= \begin{bmatrix} B_{2(3,1)} & B_{2(4,1)} \\ B_{2(3,2)} & B_{2(4,2)} \end{bmatrix} * \begin{bmatrix} F_1 & F_2 & F_3 \\ F_4 & F_5 & F_6 \\ F_7 & F_8 & F_9 \end{bmatrix} \\ &= \begin{bmatrix} B_{2(3,1)} & B_{2(4,1)} \\ B_{2(3,2)} & B_{2(4,2)} \end{bmatrix} * \begin{bmatrix} 0 & 0 & 0 \\ \frac{0.5}{3} & 0.5 & 0 \\ \frac{0.5}{3} & \frac{0.5}{3} & 0 \end{bmatrix} \end{aligned}$$

$$\begin{aligned} B_{3(4,2)} &= \begin{bmatrix} B_{2(3,1)} & B_{2(4,1)} \\ B_{2(3,2)} & B_{2(4,2)} \\ B_{2(4,3)} & B_{2(4,3)} \end{bmatrix} * \begin{bmatrix} F_1 & F_2 & F_3 \\ F_4 & F_5 & F_6 \\ F_7 & F_8 & F_9 \end{bmatrix} \\ &= \begin{bmatrix} B_{2(3,1)} & B_{2(4,1)} \\ B_{2(3,2)} & B_{2(4,2)} \\ B_{2(4,3)} & B_{2(4,3)} \end{bmatrix} * \begin{bmatrix} 0 & 0.1 & 0.1 \\ 0 & 0.5 & 0.1 \\ 0 & 0.1 & 0.1 \end{bmatrix} \end{aligned}$$

$$\begin{aligned} B_{3(4,4)} &= \begin{bmatrix} B_{2(3,3)} & B_{2(4,3)} \\ B_{2(4,3)} & B_{2(4,4)} \end{bmatrix} * \begin{bmatrix} F_1 & F_2 & F_3 \\ F_4 & F_5 & F_6 \\ F_7 & F_8 & F_9 \end{bmatrix} \\ &= \begin{bmatrix} B_{2(3,3)} & B_{2(4,3)} \\ B_{2(4,3)} & B_{2(4,4)} \end{bmatrix} * \begin{bmatrix} \frac{0.5}{3} & \frac{0.5}{3} & 0 \\ \frac{0.5}{3} & 0.5 & 0 \\ 0 & 0 & 0 \end{bmatrix} \end{aligned}$$

$$\begin{aligned} B_{3(3,4)} &= \begin{bmatrix} B_{2(2,3)} & B_{2(3,3)} & B_{2(4,3)} \\ B_{2(2,4)} & B_{2(3,4)} & B_{2(4,4)} \end{bmatrix} * \begin{bmatrix} F_1 & F_2 & F_3 \\ F_4 & F_5 & F_6 \\ F_7 & F_8 & F_9 \end{bmatrix} \\ &= \begin{bmatrix} B_{2(2,3)} & B_{2(3,3)} & B_{2(4,3)} \\ B_{2(2,4)} & B_{2(3,4)} & B_{2(4,4)} \end{bmatrix} * \begin{bmatrix} 0.1 & 0.1 & 0.1 \\ 0.1 & 0.5 & 0.1 \\ 0 & 0 & 0 \end{bmatrix} \end{aligned}$$

$$\begin{aligned} B_{3(1,4)} &= \begin{bmatrix} B_{2(1,3)} & B_{2(2,3)} \\ B_{2(1,4)} & B_{2(2,4)} \end{bmatrix} * \begin{bmatrix} F_1 & F_2 & F_3 \\ F_4 & F_5 & F_6 \\ F_7 & F_8 & F_9 \end{bmatrix} \\ &= \begin{bmatrix} B_{2(1,3)} & B_{2(2,3)} \\ B_{2(1,4)} & B_{2(2,4)} \end{bmatrix} * \begin{bmatrix} 0 & \frac{0.5}{3} & \frac{0.5}{3} \\ 0 & 0.5 & \frac{0.5}{3} \\ 0 & 0 & 0 \end{bmatrix} \end{aligned}$$

-continued $$B_{3(1,2)} = \begin{bmatrix} B_{2(1,1)} & B_{2(2,1)} \\ B_{2(1,2)} & B_{2(2,2)} \\ B_{2(1,3)} & B_{2(2,3)} \end{bmatrix} * \begin{bmatrix} F_1 & F_2 & F_3 \\ F_4 & F_5 & F_6 \\ F_7 & F_8 & F_9 \end{bmatrix}$$

$$= \begin{bmatrix} B_{2(1,1)} & B_{2(2,1)} \\ B_{2(1,2)} & B_{2(2,2)} \\ B_{2(1,3)} & B_{2(2,3)} \end{bmatrix} * \begin{bmatrix} 0 & 0.1 & 0.1 \\ 0 & 0.5 & 0.1 \\ 0 & 0.1 & 0.1 \end{bmatrix}$$

It is within the scope of the present invention to use other than nine, e.g., four, sixteen, etc., parameters for calculating each adjusted luminance value.

Furthermore, the region-based display device 200 of the invention can further include several light shielding structures (not shown) disposed between adjacent backlight regions, for preventing light of one backlight region from entering the others.

Although in the above described embodiment, backlight module 202 is illustrated as a cold cathode fluorescent lamp backlight module, the invention is not limited thereto. The backlight module 202 of the invention can also be a light emitting diode (LED) backlight module. The main colors of the LED backlight module include red (R), green (G) and blue (B). In other words, each backlight region has several luminance units each corresponding to one of the main colors. When the image region signals $G_1, G_2, \ldots G_n$ and the basis luminance values $B_1, B_2, \ldots B_n$ are transformed, the three main colors are adjusted separately to obtain, for each of the main colors, a separate set of the corresponding output image signals $G_{21}, G_{22}, \ldots G_{2n}$ and output luminance values $B_{21}, B_{22}, \ldots B_{2n}$. Furthermore, the main colors are not limited to red, green and blue. The main colors can also be other colors according to the properties of the display panel.

The region-based image display device of the above embodiments of the invention magnifies, preferably linearly, the gray scale signals of the image regions. Therefore, when the brightness of the image is low, which means the original maximum gray scale value is less than 255, the display can accept the gray scale signals with deeper image depth. As the original maximum gray scale value is magnified to 255, the display can display richer colors. Because the backlight module adjusts the luminance accordingly, power consumption is decreased and the temperature of the backlight module is lowered. Also, light leakage of liquid crystals in the dark state is decreased. Furthermore, because the light leakage of liquid crystals is decreased, contrast of the image is increased. Better viewing angle chromatism and better viewing angle contrast are obtained as well. Besides, when the display displays a pure color, the luminance values of other colors in the backlight module are turned off completely to be zero. As a result, the display can display an image with a wider color field, and the color gamut of the display is increased. Moreover, when displaying an animated image, the reaction quantity of the liquid crystals is decreased because the luminance of the backlight module is adjustable. In other words, the variation of the luminance values is shared, at least, partially by the faster adjustment of backlight. Therefore, the problem that quality of motion pictures is lowered due to slow reaction of liquid crystals is improved.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An image display device, comprising:

a backlight module having a plurality of backlight regions, each of the backlight regions comprising an adjustable luminance unit, each of the luminance units having a basis luminance value;

a separating unit for separating an input image signal into a plurality of image region signals, each of the image region signals corresponding to one of the backlight regions;

a signal-processing unit for receiving the image region signals and transforming the image region signals into a plurality of output image signals, respectively; and a modulation unit for adjusting the basis luminance values to a plurality of output luminance values, respectively, according to the image region signals, respectively;

wherein each of the basis luminance values and the corresponding image region signal cooperatively define a chromaticity and brightness, and the corresponding output luminance value and the corresponding output image signal cooperatively define substantially the same chromaticity and brightness; and wherein the signal-processing unit transforms each of the image region signals into the corresponding output image signal through linear magnification according to a maximum gray scale value of said image region signal wherein the modulation unit adjusts each of the basis luminance values to the corresponding output luminance value according to the maximum gray scale values of said image region signals;

having a gamma curve value (γ) and a gamma curve, for expressing a relation between a luminance value (B) and a gray scale value (G) of the display, the relation being $B=Gamma_y(G)$;

wherein, for an $i^{th}$ backlight region, the output luminance value $B_{2i}$ is represented by $B_{2i}=100\%\times Gamma_y(M_i)$, and the output image signal $G_{2i}$ is represented by $G_{2i}=G_{1i}\times 255/M_i$, where $G_{1i}$ is the image region signal corresponding to said $i^{th}$ backlight region, and $M_i$ is the maximum gray scale value of said image region signal $G_{1i}$.

2. The image display according to claim 1, said image display device further comprising a low pass filter for outputting, based on said output luminance values, a plurality of adjusted luminance values, respectively, for the corresponding luminance units.

3. The image display according to claim 2, wherein each of the adjusted luminance values is determined through superposition of the corresponding output luminance value.

4. The image display according to claim 1, a plurality of light shields disposed between the adjacent backlight regions, for preventing light of one backlight region from entering the others.

5. An image displaying method for use in a region-based display device, the method comprising:

providing a backlight module in the display device, wherein the backlight module has a plurality of backlight regions, each of the backlight regions comprising an adjustable luminance unit, each of the luminance units having a basis luminance value;

separating an input region signal into a plurality of image region signals, each of the image region signals corresponding to one of the backlight regions, wherein each of the basis luminance values and the corresponding image region signal cooperatively define a chromaticity and brightness;

transforming the image region signals into a plurality of output image signals, respectively; and according to the image region signals, adjusting the basis luminance values to a plurality of output luminance values, respectively, wherein each of the output luminance values and the corresponding output image signal cooperatively define substantially the same chromaticity and brightness as the corresponding basis luminance value and image region signal;

wherein in the transforming step, each said image region signal is transformed into the corresponding output image signal through linear magnification according to a maximum gray scale value of said image region signal wherein the display has a gamma curve value (γ) and a gamma curve, for expressing a relation between a luminance value (B) and a gray scale value (G) of the display, the relation being $B=Gamma_{\gamma}(G)$;

wherein, for an $i^{th}$ backlight region, the output luminance value $B_{2i}$ is represented by $B_{2i}=100\%\times Gamma_{\gamma}(M_i)$, and the output image signal $G_{2i}$ is represented by $G_{2i}=G_{1i}\times 255/M_i$, where $G_{1i}$, is the image region signal corresponding to said $i^{th}$ backlight region, and $M_i$ is the maximum gray scale value of said image region signal $G_{1i}$.

* * * * *